US005913461A

United States Patent [19]

Boudreau et al.

[11] Patent Number: 5,913,461

[45] Date of Patent: Jun. 22, 1999

[54] GLOVE DRYING AND SHAPING DEVICE

[76] Inventors: Mark S. Boudreau, 808 Ramsey St.; Joseph L. Hodges IV, 806 Ramsey St., both of Alexandria, Va. 22301

[21] Appl. No.: 08/602,274

[22] Filed: Feb. 16, 1996

[51] Int. Cl.[6] ..... A41D 1/00

[52] U.S. Cl. ..... 223/78; 223/80

[58] Field of Search ..... 223/78, 79, 80, 223/84

[56] References Cited

U.S. PATENT DOCUMENTS

| | | | |
|---|---|---|---|
| D. 25,538 | 5/1896 | Peabody . | |
| 606,628 | 6/1898 | Hull . | |
| 686,884 | 11/1901 | Becker . | |
| 1,733,680 | 10/1929 | Turner . | |
| 1,755,605 | 4/1930 | Knox . | |
| 2,524,285 | 11/1950 | Chezum . | |
| 2,783,925 | 3/1957 | Ross . | |
| 3,159,504 | 12/1964 | Sarjanian et al. . | |
| 3,486,670 | 12/1969 | Sutton | 223/78 |
| 3,917,266 | 11/1975 | Kiey . | |
| 4,018,382 | 4/1977 | Di Cuya | 223/78 |
| 4,084,733 | 4/1978 | Perlmutter . | |
| 4,565,287 | 1/1986 | Rede et al. | 223/78 |
| 4,697,724 | 10/1987 | Pitcher | 223/78 |
| 5,011,053 | 4/1991 | Davies | 223/78 |
| 5,117,565 | 6/1992 | Willenbacher, Jr. . | |
| 5,125,169 | 6/1992 | Bader | 223/78 |
| 5,234,141 | 8/1993 | Spiece | 223/78 |

*Primary Examiner*—Bibhu Mohanty
*Attorney, Agent, or Firm*—Barnes & Thornburg

[57] ABSTRACT

A substantially planar hand-shaped glove drying device which includes a palm portion, a plurality of finger element which extend from the palm portion and a thumb element which is connected to the palm portion by a spring member. A display area extends from a lower portion of the device and provides an area where indicia such as the logo of a country club, golf equipment manufacturer, of the like can be displayed when the device is used as a golf bag tag. A ridge structure extends around a periphery of the device to provide structural support and to prevent a glove fitted thereon from contacting the surface of the palm structure.

9 Claims, 2 Drawing Sheets

GLOVE DRYING AND SHAPING DEVICE

TECHNICAL FIELD

The present invention relates to a glove drying device. More particularly, the present invention relates to a hand-shaped glove drying form over which a saturated glove may be placed to retain its shape and facilitate drying.

BACKGROUND ART

Glove drying supports are generally known in the art and usually consist of a palm supporting portion from which extends three or four fixed finger supports or digits. These finger supports or digits are generally immobile with respect to the plane of the palm supporting portion. Also known are glove drying supports which are equipped with a thumb supporting element in addition to the usual three or four digits. These thumb supporting elements are likewise generally immobile with respect to the plane of the palm supporting portion.

There are a few glove drying supports which include movable thumb elements. For Example U.S. Pat. Nos. 4,018,382; 3,486,670; 3,159,504; 2,783,925; and 686,884 are directed to glove drying devices which include movable thumb elements. As can be observed from these patents the movable thumb elements are often mechanically complicated, adding to the costs of the devices.

Glove drying devices exemplified in U.S. Pat. Nos. 5,234,141; 5,117,565; 5,011,053; 4,084,733; 3,917,266; 2,524,285; 1,755,605; 1,733,680; 606,628 and Des. 25,538, which do not include movable thumb elements are awkward to use because the rigidity of the thumb element makes it difficult to fit the drying forms through the wrist portion of a glove, particularly a moisture laden glove.

The use of glove drying devices is particularly appealing to golfers who often wear a single golf glove which is typically made of leather and is relatively expensive. Such golf gloves often become wet or damp from perspiration or precipitation during use. If wet or damp golf gloves are balled or rolled up and stored in golf bags or the like and not properly dried, they become wrinkled, deformed, and prematurely crack and wear out.

For advertising purposes, golf courses customarily provide golfers with bag tags, which are often collected by golfers. Bag tags provided by prestigious golf courses are sought after and usually visibly displayed on the golf bags of golfers.

The present invention is directed to a glove drying device which, in addition to functioning as a easy to use form on which to dry gloves, incorporates a structure which is particularly suitable for advertising purposes.

DISCLOSURE OF THE INVENTION

It is accordingly one object of the present invention to provide a glove drying device which is easy to use.

It is another object of the present invention to provide a glove drying device which allows for adequate drying of a wet or damp glove, including all the digits of such a glove.

Another object of the present invention is to provide an inexpensive glove drying device.

A further object of the present invention is to provide a glove drying device which can be used as a golf club bag tag.

A still further object of the present invention is to provide a glove drying device which is durable and easy to manufacture.

An even further object of the present invention is to provide a glove drying device which can be used with a variety of gloves and glove sizes.

An even further object of the present invention is to provide a glove drying device which is made from a single unitary structure and includes a movable thumb element.

According to these and further objects of the present invention which will become apparent as the description thereof proceeds below, the present invention provides a glove drying device which includes:

a substantially planar hand-shaped form including a palm portion, a plurality of finger elements which extend from the palm portion and a thumb element which is connected to the palm portion by a spring member;

a display area extending from a lower portion of the substantially planar hand-shaped form and consisting of a substantially continuous surface for receiving indicia; and a ridge structure which extends around a periphery of the substantially planar hand-shaped structure.

BRIEF DESCRIPTION OF DRAWINGS

The present invention will be described hereafter with reference to the attached drawings which are given as non-limiting examples only, in which.

BEST MODE FOR CARRYING OUT THE INVENTION

Figure 2:
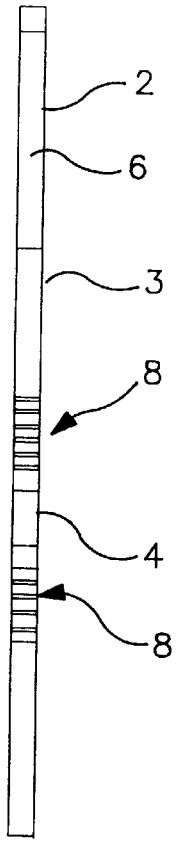
FIG. 2 is a side view of the glove drying device shown in FIG. 1 taken alone line B—B.
Figure 1:
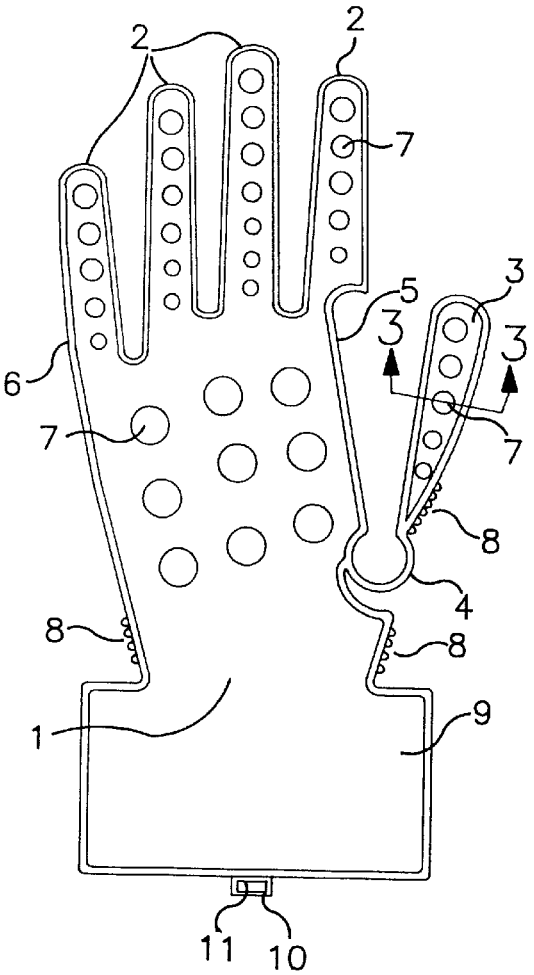
FIG. 1 is a front view of a glove drying device according to one embodiment of the present invention.

The glove drying device of the present invention generally includes a hand-shaped structure which can be inserted unto a wet or damp glove for purposes of maintaining the shape of glove as the glove is dried. The device is hand-shaped in that it includes a palm-shaped portion and finger elements or digits extending from the palm-shaped portion, together with a thumb element as depicted in FIG. 1. Otherwise, the device has a generally planer shape as depicted in FIG. 2.

The palm portion, finger digits and thumb element include planar structures which together define hand-shaped pattern. In order to facilitate uniform drying of a glove, the device includes a number of structural elements, including a ridge which extends along the entire periphery of the device and beyond each of the planar surfaces of the palm portion, finger digits and thumb element. This ridge structure makes the overall structure of the device rigid and prevents a glove from being in direct contact with the planar surfaces of the device and thus facilitates ventilation during drying. In addition to the ridge which extends along the entire periphery of the device, there are ventilation openings provided in the planar surfaces of the palm portion, finger digits and thumb element.

As will be discussed in detail below, the thumb element is movably attached to the palm portion. This is achieved by incorporating a spring member between the thumb element and the palm portion. The use of a movable thumb element allows the thumb element to be moved into a position near the palm portion at which the thumb element can be easily inserted through the wrist portion of a glove and further allows the thumb element, after insertion, to move into a position in which the thumb of the glove is spread out from the palm portion.

For use as a golf bag tag, the glove drying device of the present invention includes an area below the palm portion on which indicia, such as the logo of a country club, a golf equipment manufacturer, of the like can be displayed. This display area is continuous and preferably substantially flat. The display area can be rectangular, circular, or have any desired shape.

FIG. 1 is a front view of a glove drying device according to one embodiment of the present invention. As shown in FIG. 1, the glove drying device of the present invention includes a palm-shaped portion 1 to which is attached a plurality of finger digits or elements 2, and a thumb element 3. The embodiment of the device shown in FIG. 1 includes four finger elements 2. However fewer, e.g., three finger elements 2 could be used if desired.

The finger elements 2 extend from the palm portion 1 so as to provide a continuous planar structure with the palm portion 1. The thumb element 3 does not extend in a continuous manner from the palm portion 1. Instead, the thumb element 3 is attached to the palm portion 1 by a spring member 4. The spring member 4 allows the thumb element 3 to be moved into a position near the palm portion 1 at which position the thumb element 3 can be easily inserted into the thumb of a glove. The spring member 4 further (by its biasing force) allows the thumb element 3, after insertion into a glove, to move into a position in which the thumb of the glove is spread out from the palm portion 1. This allows a damp or wet glove to be supported in the natural opened position of a hand during drying on the device.

The spring member 4 allows the thumb element 3 to move or pivot toward and away from the palm portion 1, but can resist movement of the thumb element 3 out of the plane of the palm portion 1. In this regard, the spring member 4, as illustrated, is preferably a curved, flat element which forms a resilient bridge between the palm portion 1 and the thumb element 3.

The palm portion 1 includes a cut out section 5 adjacent the thumb element 3 which can receive the thumb element 3 when the thumb element 3 is pushed against the bias force of spring member 4 toward the palm portion 1. This allows the thumb element 3 to be moved into a position in which it can easily pass through the wrist portion of a glove.

A ridge structure 6 extends along the entire periphery of the glove drying device. The purpose of the ridge 6 is to support a glove on the device in such a manner that the glove does not come into contact with the flat surface of the palm portion 1, the finger elements 2 or the thumb element 3. Some contact of the glove with the flat surface of the palm portion 1 may be unavoidable. However, the ridge portion 6 will prevent contact between a significant area of the glove and the flat surface of the palm portion 1. In the illustrated embodiment of the invention, the spring element 4 is depicted as being an extension of the ridge 6. This design has been determined to simplify manufacturing of the device.

As shown in FIG. 1, a plurality of ventilation openings 7 are provided in the palm portion 1, the finger elements 2, and the thumb element 3. These ventilation openings 7 facilitate ventilation of air during drying so that more even drying can occur.

The tips of the finger and thumb elements are curved or rounded so as to more easily pass into a glove. Once a glove is on the drying device, holding elements 8 provided on the lower edges of the palm portion 1 and thumb element 3 prevent the glove from sliding off the device. Holding elements 8 comprise raised or roughened structures or protrusions on the lower portion of the palm portion 1 and thumb element 3. In addition to securing a glove to the glove drying device, the holding elements 8 on the thumb element—provide a gripping surface on the otherwise smooth peripheral ridge on which to press the thumb element 3 toward the palm portion 1 when fitting the device into a glove. In addition, the holding members 8 adjacent the lower portion of the palm portion 1 allow the device to be securely gripped by hand during the initial stages of fitting a glove onto the device.

A display area or tag portion 9 is provided below the palm portion 1 and comprises an continuous extension of the flat planar surface of the palm portion 1. The display area or tag portion 9 is preferably continuous and flat so that indicia, such as the logo of a country club, golf equipment manufacturer, of the like can be displayed thereon. The display area or tag portion 9 can be rectangular as shown or circular or have any desired shape.

Indicia to be displayed on the display area or tag portion 9 can be printed directly thereon or applied as a label, molded thereon, or provided according to any convenient manner. In some instances the displayed indicia may include openings in the otherwise continuous surface of the display area or tag portion 9. As shown, the ridge 6 preferably extends about the periphery of the display area or tag portion 9 to add structural rigidity to the overall device.

In order to hang the device to a golf bag, a slotted tab 10 is provided on a side of the display area or tag portion 9. The slotted tab 10 can be outside the ridge 6 and can be thinner than or as thick as the height of the ridge 6. The slotted tab 10 includes a through-hole 11 though which a cord, chain, hook, of the like can be fastened and used to hang the device from a golf bag. Providing the slotted tab 10 as a separate structural element avoids providing a through-hole in the surface of the display area or tag portion 9, which might interfere with a desired indicia to be displayed thereon. It is to be understood that the through-hole 11 can be in the form of a slot, rounded, oval-shaped, or have any convenient shape.

FIG. 2 is a side view of the glove drying device shown in FIG. 1 taken alone line B—B. As can be seen in FIG. 2, the device of the present invention is substantially planar. The holding elements 8 are shown in FIG. 2 as comprising elongated protrusions (see also FIG. 1).

Figure 3:
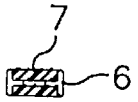
FIG. 3 is a cross sectional view of the glove drying device shown in FIG. 1 taken alone line A—A.

FIG. 3 is a cross sectional view of the glove drying device shown in FIG. 1 taken alone line A—A.

In FIG. 1 the relative size of the ridge 6 and flat surface of the thumb element 3 is shown. These dimensions are only relative inasmuch as the figures are not necessary drawn to scale.

Figure 4:
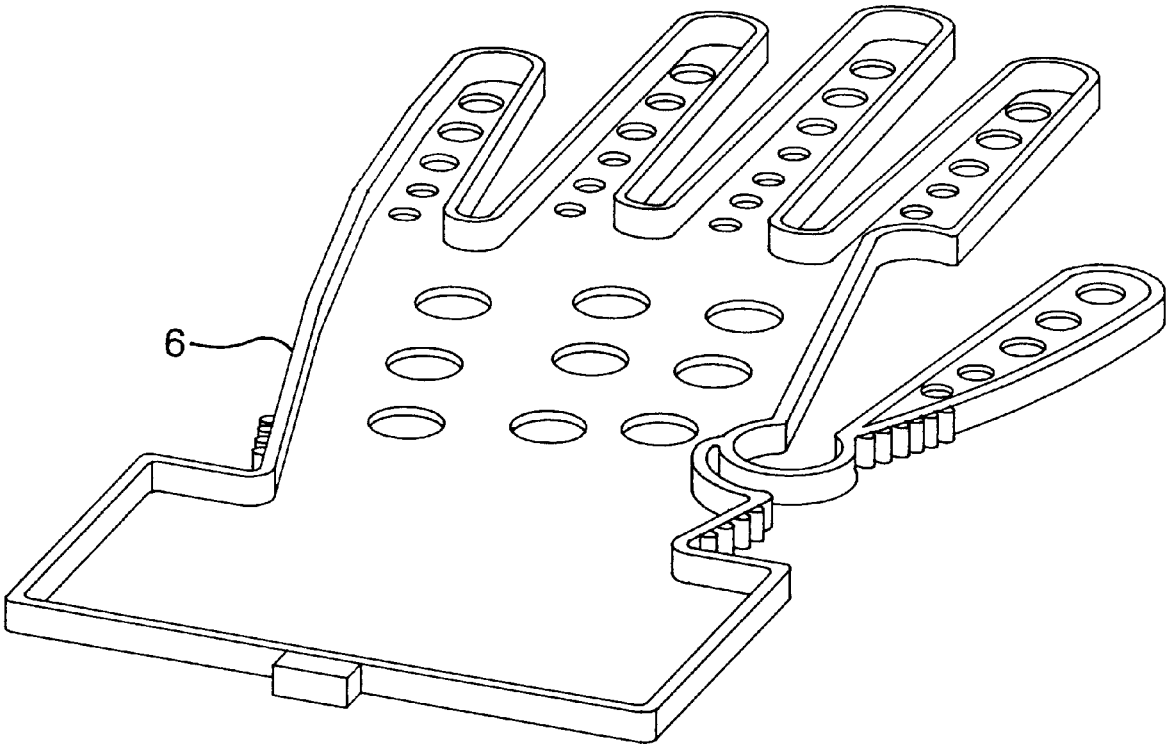
FIG. 4 is a front isometric view of the glove drying device of FIG. 1.

FIG. 4 is a front isometric view of the glove drying device of FIG. 1. FIG. 4 best illustrates the structure of the spring member 4 according to one embodiment of the present invention.

The glove drying device of the present invention is preferably made from a plastic material. The design and shape of the device illustrated in the figures can be molded as a single structure utilizing known techniques. In other embodiments, the spring member 4 could include other structure such as a non-biased pivot mechanism between the palm portion 1 and the thumb element 3 which is supplemented by a separate spring member.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed:

1. A glove drying device which comprises:

a substantially planar hand-shaped form having two continuous opposed planar surfaces defined by a palm portion and a plurality of finger elements which extend from said palm portion, said substantially hand-shaped form further including a thumb element which is connected to said palm portion by a spring member;

a display area attached to and extending beyond a lower portion of said substantially planar hand-shaped form and consisting of a substantially continuous surface for receiving indicia;

a ridge structure which extends perpendicularly beyond each of said two continuous opposed planar surfaces and around a periphery of said substantially planar hand-shaped form and around a periphery of said display area; and a slotted tab which extends from said display area and beyond said ridge structure.

2. A glove drying device which comprises:

a substantially planar hand-shaped form having two continuous opposed planar surfaces defined by a palm portion and a plurality of finger elements which extend from said palm portion, said substantially hand-shaped form further including a thumb element which is connected to said palm portion by a spring member;

a display area attached to and extending beyond a lower portion of said substantially planar hand-shaped form and consisting of a substantially continuous surface for receiving indicia; and a ridge structure which extends perpendicularly beyond each of said two continuous opposed planar surfaces and around a periphery of said substantially planar hand-shaped form, a slotted tab which extends from said display area and beyond said ridge structure, wherein said display area is rectangular.

3. A glove drying device which comprises:

a substantially planar hand-shaped form having two continuous opposed planar surfaces defined by a palm portion and a plurality of finger elements which extend from said palm portion, said substantially hand-shaped form further including a thumb element which is connected to said palm portion by a spring member;

a display area attached to and extending beyond a lower portion of said substantially planar hand-shaped form and consisting of a substantially continuous surface for receiving indicia;

a ridge structure which extends perpendicularly beyond each of said two continuous opposed planar surfaces and around a periphery of said substantially planar hand-shaped form; and holding means for securing a glove on said glove drying device, said holding means being located on said thumb element adjacent said spring member.

4. A glove drying device according to claim 3, wherein said holding means comprises protrusions which extend from said ridge structure.

5. A glove drying device according to claim 4, further comprising additional holding means on opposite sides of said palm portion adjacent said display area.

6. A glove drying device comprising:

a substantially planar hand-shaped form having two continuous opposed planar surfaces defined by a palm portion and a plurality of finger elements which extend from said palm portion, said substantially hand-shaped form further including a thumb element which is connected to said palm portion by a spring member;

a display area attached to and extending beyond a lower portion of said substantially planar hand-shaped form and consisting of a substantially continuous surface for receiving indicia; and a ridge structure which extends perpendicularly beyond each of said two continuous opposed planar surfaces and around a periphery of said substantially planar hand-shaped structure, wherein said palm portion includes a cut-out section adjacent said thumb element which receives said thumb element when said thumb element is pushed toward said palm portion.

7. A glove drying device according to claim 2, wherein said rectangular display area is wider than the lower portion of said substantially planar hand-shaped form.

8. A glove drying device according to claim 6, wherein said cut-out section is complementarily shaped to said thumb element for receiving the same therein.

9. A glove drying device which comprises:

a substantially planar hand-shaped form having two continuous opposed planar surfaces defined by a palm portion and a plurality of finger elements which extend from said palm portion, said substantially hand-shaped form further including a thumb element which is connected to said palm portion by a spring member;

a display area attached to and extending beyond a lower portion of said substantially planar hand-shaped form and consisting of a substantially continuous surface for receiving indicia; and a ridge structure which extends perpendicularly beyond each of said two continuous opposed planar surfaces and around a periphery of said substantially planar hand-shaped form, wherein said spring member is semi-circular.

* * * * *